United States Patent [19]

Seanor et al.

[11] 4,227,234

[45] Oct. 7, 1980

[54] CORONA CHARGING ELEMENT

[75] Inventors: Donald A. Seanor, Pittsford; Judy P. Nagel, Romulus, both of N.Y.

[73] Assignee: Xerox Corporation, Stamford, Conn.

[21] Appl. No.: 921,421

[22] Filed: Jul. 3, 1978

[51] Int. Cl.[2] ..... H05F 3/04

[52] U.S. Cl. ..... 361/229

[58] Field of Search ..... 361/212, 213, 229, 230; 427/175; 29/25.17; 313/345, 354, 355; 204/176; 250/532

[56] References Cited

U.S. PATENT DOCUMENTS

| | | | |
|---|---|---|---|
| 2,904,846 | 9/1959 | Smith | 427/175 X |
| 3,634,726 | 1/1972 | Jay | 361/220 |
| 3,789,278 | 1/1974 | Bingham et al. | 361/229 |
| 3,954,586 | 5/1976 | Lowther | 204/176 |
| 4,086,650 | 4/1978 | Davis et al. | 361/229 |

FOREIGN PATENT DOCUMENTS 450688 10/1970 Australia .

1438995 6/1976 United Kingdom .

OTHER PUBLICATIONS

*Encyclopedia of Chemical Technology,* Kirk-Othmer, vol. 10, 1964, pp. 538-546 and pp. 583-587.

*Primary Examiner*—Harry E. Moose, Jr.
*Assistant Examiner*—L. C. Schroeder

[57] ABSTRACT

Corona discharge electrodes are coated with compressed dielectric materials. A corona discharge electrode is placed under tension and coated with a molten, viscous dielectric material, such as glass, while under tension. The dielectric material is allowed to cool so that the dielectric material becomes bonded securely to the corona discharge electrode. The tension upon the corona discharge electrode is released thereby causing a compression of the dielectric material adhered thereto. The resulting dielectric coated corona discharge electrode has a substantially improved life and delivers substantially uniform currents.

25 Claims, 2 Drawing Figures

CORONA CHARGING ELEMENT

BACKGROUND OF THE INVENTION

The present invention relates to corona discharge members used for depositing a charge on an adjacent surface, and more particularly, relates to corona discharge electrodes and a method of making corona discharge electrodes.

In the electrophotographic reproducing arts, it is necessary to deposit a uniform electrostatic charge on an imaging surface, which charge is subsequently selectively dissipated by exposure to an information containing optical image to form an electrostatic latent image. The electrostatic latent image may then be developed and the developed image transferred to a support surface to form a final copy of the original document.

In addition to precharging the imaging surface of a xerographic system prior to exposure, corona devices are used to perform a variety of other functions in the xerographic process. For example, corona devices aid in the transfer of an electrostatic toner image for a reusable photoreceptor to a transfer member, the tacking and de-tacking of paper to the imaging member, the conditioning of the imaging surface prior to, during and after the deposition of toner thereon to improve the quality of the xerographic copy produced thereby, the cleaning of certain photoconductive members and the like. Both direct current and alternating current type corona devices are used to perform many of the above functions.

One type of improved corona charging device is disclosed in U.S. Pat. No. 4,086,650 wherein the corona discharge member comprises a thin wire, coated at least in the discharge area with a dielectric material. In a preferred embodiment, this corona discharge member is positioned above a charge collecting surface carried on a conductive substrate held at a reference potential, and it is provided with means for coupling a corona generating voltage intermediate the conductive substrate and the wire of the corona discharge member. A conductive shield adjacent the wire and a first biasing means for holding the shield at a potential different from the reference potential is also provided in the preferred embodiment.

Many of the prior art problems conventionally associated with charging devices have been overcome by the dielectric-coated thin wire of U.S. Pat. No. 4,086,650. However, improved uniformity in currents and increased life of the dielectric-coated wire are desirable.

OBJECTS AND SUMMARY OF THE INVENTION

Accordingly, this invention has as its primary object the provision of an improved corona discharge member of the type having an inner conductive electrode and an outer dielectric coating.

A further object of this invention is to provide a corona discharge member of the type having an inner conductive electrode and an outer dielectric coating having an increased useful charging life.

Another object of this invention is to provide a corona discharge member of the type having an inner conductive electrode and an outer dielectric coating wherein the charge is substantially more uniform than that deposited by the prior art corona devices.

Still another object of this invention is to provide an improved method for making a corona discharge member of the type having an inner conductive electrode and an outer dielectric coating.

The above-cited objects of the present invention are accomplished by a corona discharge member of the type having an inner conductive electrode and an outer dielectric coating, the outer dielectric coating being under compression.

One of the methods of providing compression in the outer dielectric coating so that there is a residual compression in the dielectric material when the corona discharge member is placed in operation, is to make the corona discharge member by first applying stress to the inner conductive electrode; coating the inner conductive electrode with a dielectric coating capable of being compressed, said dielectric being in a softened or molten state; cooling the dielectric after it has been deposited upon the surface of the inner conductive electrode; and releasing the stress on the inner conductive electrode. In this way, the inner conductive electrode contracts causing a compression of the outer dielectric coating. An interfacial bond between the dielectric material and the inner conductive electrode results in the transfer of the "load" (tension) from the inner conductive electrode to the dielectric coating materialwhen the tension on the inner conductive electrode member is removed or released.

As used herein, "compression" defines the mechanical properties of the outer dielectric coating wherein the coating is under a compressive stress as described on page 586 of *Encyclopedia of Chemical Technology*, Kirk-Othmer, Vol. 10, 1964. Many well-known techniques may be used to impart the compression to the outer dielectric coating, and one of the preferred techniques is described below. As used herein, compression and compressive stress may be used interchangeably.

In accordance with the present invention, it has been discovered that corona discharge electrodes of the type having a dielectric material coating a conductive inner core member not only have substantially improved operating lives but also are characterized by substantially fewer failures due to handling when the dielectric material coating the inner conductive core is compressed. Furthermore, it has been discovered that coronodes (corona discharge electrodes) having the dielectric coating under compression are able to withstand a higher tensile load than the conventional coronodes having the dielectric coating with no compression. Thus, the coronodes of the present invention can be strung in supports under higher loads. This has the advantage of minimizing vibrations which are sometimes associated with the operation of coronodes. In turn reduction of vibration reduces the temporal variation of charge density laid down upon a substrate which results from the temporal variation in coronode/substrate spacing.

DESCRIPTION OF THE PREFERRED EMBODIMENTS

Figure 2:
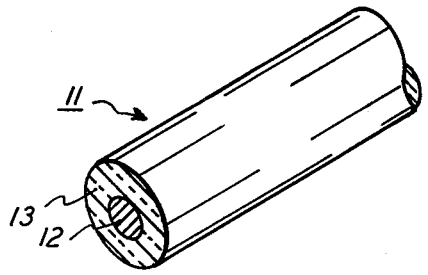
FIG. 2 is a pictorial perspective illustrating partially in section a corona discharge member made in accordance with the present invention.

Referring to FIG. 2, the corona discharge member 11 of the present invention is seen to comprise an inner conductive electrode 12 having a relatively thick coating 13 of dielectric material, the dielectric material being under compression. More particularly, corona discharge member 11 is the type having an inner conductive electrode 12 and an outer dielectric coating 13, the outer dielectric coating 13 being under compression.

Exemplary of the device in which the corona discharge member of the present invention may be used, is the corona charging device of U.S. Pat. No. 4,086,650. In U.S. Pat. No. 4,086,650, there is described a corona discharge arrangement which comprises a corona electrode coated with a relatively thick dielectric material and located adjacent a conductive shield. Spaced from the wire is a charge collecting surface which may be carried on a grounded substrate. In one mode of operation in U.S. Pat. No. 4,086,650, an a.c. corona generating voltage is applied to the inner conductive electrode (wire) and no electric field is established between the collecting surface and the shield by holding each at the same reference potential. When operated in this mode, no net charging current is delivered to the surface. In a second mode, a d.c. field is established between the shield and the surface which acts to control both the polarity and the magnitude of charging current delivered to the surface. U.S. Pat. No. 4,086,650 is incorporated herein by reference and embraces claims directed to, in combination, a charge collecting surface, said surface carried on with a conductive substrate held at a reference potential, a corona discharge member positioned above said surface, said member comprising a thin wire, coated at least in the discharge area with a dielectric material, means for coupling a corona generating a.c. voltage intermediate said substrate and said wire, a conductive shield against said wire and first biasing means for holding said shield at a potential different than said reference potential, said dielectric material having a thickness sufficient to prevent the flow of a net d.c. current through said wire.

In the prior art corona discharge members, the outer dielectric coating is generally deposited upon the inner conductive electrode when the inner conductive electrode is in a relaxed state, that is, when there is no stress or tension upon the inner conductive electrode. The outer dielectric coating deposited in this manner is also in a relaxed state, that is, there is no tension or compression or any other stress or strain thereon. In accordance with the present invention, the outer dielectric coating must be under compression when the corona discharge member is in a completed state, that is, when the corona discharge member has been produced or manufactured and is at rest outside of a machine, apparatus or other environment which generally connects the ends of the corona discharge member to a power supply. Furthermore, the corona discharge member of the present invention must have an outer dielectric coating which is under compression even when the corona discharge member is mounted within, mounted upon or otherwise connected to a machine or apparatus environment wherein the corona discharge member is connected to a power supply or any tensioning device which supports the corona discharge member within mounting blocks or any other mounting means. For example, in U.S. Pat. No. 4,086,650, when the corona wire is supported in conventional fashion at the ends thereof by insulating end blocks mounted within the ends of a shield structure, the outer dielectric coating of the corona discharge member must be under compression when mounted therein.

Compressive stress upon the surface may be attained in any of various well-known techniques. One method of obtaining compressive stress upon the surface in accordance with the present invention where there is an inner element upon which the outer element is deposited, is to apply stress or tension to the inner element, deposit the outer element thereon while the inner element has stress applied thereto, adhere the outer element firmly to the inner element and then release the stress or tension previously applied to the inner element. This method is described in more detail below and embraces the preferred method of making the corona discharge member of the present invention. Since the present invention pertains to, in essence, a laminated material comprising an inner element and an outer element coated thereover, other methods of obtaining an outer element having compressive stress (compression) can be easily devised. Surface compressions can be easily attained by various lamination techniques. For example, when the dielectric material or coating is a crystalline material, the outer dielectric element can be compressed by surface crystalization.

Generally, the corona discharge member of the type having an inner conductive electrode and an outer dielectric coating, the outer dielectric coating being under compression, is similar in appearance to the prior art corona discharge members wherein the outer dielectric coating is in a relaxed state (no compression). Accordingly, a visual examination of the corona discharge member with the naked eye will reveal no distinctive characteristics which distinguish the corona discharge member of the present invention from the prior art corona discharge members. However, an examination of the corona discharge member of the present invention utilizing various instruments will illustrate the features of the corona discharge member of the present invention which distinguish it from the prior art corona discharge members having an outer dielectric coating with no compression. When the corona discharge member of the type having an inner conductive electrode and an outer dielectric coating, the outer dielectric coating being under compression, of the present invention is examined with the aid of a polarimeter, the outer dielectric coating at least near the interface between the inner conductive electrode and the dielectric material is a blue or blue/green color when the dielectric material is glass. In the absence of compression in the outer dielectric coating, the color of the glass at least at the interface of the inner conductive electrode and the dielectric material is gray. Not only is this a test for determining if a corona discharge member having an inner conductive electrode and an outer dielectric coating has an outer dielectric coating under compression, but it is also a means for determining the amount of compression in pounds/square inch (p.s.i.). This test will be described in more detail below.

In accordance with the present invention, when the described compression or compressive stress is present in the outer dielectric coating of the corona discharge member, there is substantial improvement in the charging characteristics of the corona discharge member when it is used in a xerographic environment such as the one described in U.S. Pat. No. 4,086,650. Among these improvements is the control of or elimination of static fatigue failure as well as dynamic fatigue failure. Furthermore, more uniform currents can be generated and delivered to the surface being charged. Even though the corona discharge member of the present invention is characterized by the foregoing improvements, there is no sacrifice of the other characteristics of the corona discharge members having inner conductive electrodes and outer dielectric coatings of the prior art over those corona discharge members of the prior art which have no outer dielectric coating. For example, the corona discharge member of the present invention also has the reduced sensitivity to dirt on the shield and the corona discharge member the same as the prior art corona discharge members having inner conductive electrodes and outer, non-compressed dielectric coatings.

The amount of compression or compressive stress required in the outer discharge coating is dependent upon the particular material applied as the dielectric. The preferred amount of compression in the dielectric coating and the optimum compression in the dielectric coating can be easily determined by one skilled in the art from the teachings of the present specification. For example, the amount of compression in the outer dielectric coating of the corona discharge member can be determined by using the polarimeter and the life and performance of the corona discharge member having the known amount of compression in the outer dielectric coating can be determined. In this manner, optimum and preferred compressive stress can be determined for any given dielectric material coating the inner conductive electrode of the corona discharge member.

The preferred compression in any given electrode is dependent upon the diameter of the inner conductive electrode and the thickness of the dielectric sheath coated thereon. From the teachings of the present invention, optimum compression in the dielectric material can be determined for any given dielectric material and the diameters of the inner conductive member and outer dielectric member. For example, a 3 mil (0.076 m.m.) core and a 1–9 mil (0.025–0.229 m.m.) thickness of dielectric coating should have a preferred compression between about 8,000 p.s.i. (560 kg/cm$^2$) and about 12,000 p.s.i. (840 kg/cm$^2$). A 5 mil (0.127 m.m.) core (inner conductive electrode) and a 1–15 mil (0.0254–3.81 m.m.) thickness of dielectric coating should have a preferred compression between about 4,000 p.s.i. (280 kg/cm$^2$) and about 10,000 p.s.i. (700 kg/cm$^2$).

Generally, the amount of compression in the dielectric coating is preferably from about 500 to about 20,000 p.s.i. (35–1,400 kg/cm$^2$). Optimum results are generally obtained when the outer dielectric coating has a compression in excess of 6,000 p.s.i. (420 kg/cm$^2$). When the outer dielectric coating of the corona discharge member is compressed ceramic, the preferred compression is from about 300 to about 8,000 p.s.i. (21–560 kg/cm$^2$). Generally, the minimum compression of the dielectric coating at which the improvement of the present invention is observed, is about 100 p.s.i. (7 kg/cm$^2$).

The compressive stress present in the outer dielectric coating, for example, glass, can be determined by use of a polarimeter and a refractive index fluid which matches the refractive index of the dielectric material. A sample of the corona discharge member, the compressive stress of the outer dielectric coating of which the measurement is being taken, is placed on a strain-free glass slide with the refractive index fluid having the same index of refraction as the dielectric material. The polarimeter tint plate is placed in the light path and the rotor of the polarimeter is set at 0. The sample is then placed in the light path between the light source and the tint plate at an angle 45° from the neutral axis. The stress in the dielectric material is indicated by the color of the material. Depending upon the position of the dielectric material in the field and whether the dielectric material is in compression or tension, a shade of blue/green or yellow/orange will be observed. Compression in the glass is indicated by a blue/green color whereas tension in the glass is measured by a yellow/orange color. If the glass appears as a neutral color or pink (the same color as the background), the glass is considered stress free. Following this observation, the quarter wave plate is slid into place and the rotor is turned from the 0 position in a direction that will move the black neutral band of the polarimeter toward the interface between the inner conductive electrode and the outer dielectric coating, that is, for example toward the wire/glass interface when the inner conductive electrode is a wire and the outer dielectric coating is glass. When the neutral band has reached the interface (so that no blue or blue/green color is visible), the angle through which the rotor has turned is noted. This angle is then used to calculate the stress in the dielectric material. The formula for calculating the stress in the glass is as follows:

$$S = 1840 \frac{A}{T \times C}$$

wherein A is the angle computed from the rotation of the rotor from the 0 position as described above; T is the thickness of the dielectric coating in inches; and C is the birefringence constant of the dielectric material. The foregoing method describes mainly the method used for determining the compressive stress in glass or a similar clear material through which the inner conductive electrode is optically visible when placed in the light path of the polarimeter. Exemplary of a suitable polarimeter is the Model 33 Polarimeter supplied by Polametrics, Inc., Corning, N.Y.

The dielectric coating materials which may be used to coat the inner conductive electrode of the corona discharge member, must be chemically inert and not susceptible to chemical reaction by the reactive species produced by the reaction of the corona and the atmosphere in the environment surrounding the corona. For example, the dielectric coating material must resist the chemicals which result from the electrical discharge in the atmosphere. One such chemical is ozone. Furthermore, the dielectric coating material should have a high dielectric breakdown strength; it should be free of voids; it must firmly adhere to the inner conductive electrode element both under static and dynamic conditions; and it is preferably able to withstand stress loadings of 10,000 p.s.i. or greater. Accordingly, glass materials and ceramic materials which meet these criteria are suitable as dielectric coating materials for coating the inner conductive electrode with an outer dielectric coating under compression. Preferred glass materials which may be used as the outer dielectric coating when the outer dielectric coating is to be compressed in accordance with the present invention, include any glass composition having the criteria discussed above. Glass compositions and glass-forming systems are discussed at pages 538–546 of *Encylopedia of Chemical Technology*, Kirk-Othmer, Volume 10, 1964. Typical and exemplary glasses include silica glass, alkali silicate glass, soda-lime glasses, borosilicate glass, aluminosilicate glass, and lead glass.

One exemplary glass which may be used in accordance with the present invention is designated under glass code 1720 and contains (by weight) 62% $SiO_2$, 17% $Al_2O_3$, 5% $B_2O_3$, 1% $Na_2O$, 7% MgO and 8% CaO. Another typical glass is designated glass code 3320 and contains (by weight) 76% $SiO_2$, 3% $Al_2O_3$, 14% $B_2O_3$, 4% $Na_2O$, 2% $K_2O$ and 1% $U_3O_8$. Many other typical commercial silicate glass compositions which are useful in this invention are found in Table 3, pages 542 and 543 of *Encylopedia of Chemical Technology*, Kirk-Othmer, Volume 10, 1974. Other glasses may be formed from $B_2O_3$, $GeO_2$, $P_2O_5$, $As_2O_5$, $P_2O_3$, $As_2O_3$, $Sb_2O_3$, $B_2O_5$, $Cb_2O_5$, $Sb_2O_5$ and $Ta_2O_5$. Additional glasses may be selected by one skilled in the art as long as the above-mentioned criteria are met and especially if the glass firmly adheres or bonds to the inner conductive electrode, such as tungsten wire, and if a compressive stress is present in the glass after the glass has been applied to the inner conductive electrode.

Ceramics which are capable of forming void-free coatings on inner conductive electrodes, can also be used as the dielectric coating material in accordance with the present invention if the necessary compression can be transferred from the inner conductive electrode to the ceramic material. Ceramic materials are discussed at pages 759–832 of *Encyclopedia of Chemical Technology*, Kirk-Othmer, Volume 4, 1964. Typical ceramics which may be used in accordance with the present invention, include the silica ceramics, feldspar ceramics, nepheline syenite ceramics, lime ceramics, magnesite ceramics, dolomite ceramics, chromite ceramics, aluminum silicate ceramics, magnesium silicate ceramics, and the like.

Glass ceramics, also well known in the art, may also be used in accordance with the present invention as long as the criteria described above are met by the particular glass ceramic material.

As discussed above, any suitable dielectric material may be employed as coating 13 in the corona discharge member of FIG. 2 as long as the material can be compressed upon the inner conductive electrode or electrodes and as long as the material will not break down under the applied corona voltage. The inorganic dielectrics have been found to perform more satisfactorily than organic dielectrics due to their higher voltage breakdown properties and greater resistance to chemical reaction in the corona environment. However, organic dielectric materials may also be used in accordance with the present invention as long as the appropriate compressive stress can be formed within or applied to the dielectric material coating the inner conductive electrode and as long as they are sufficiently stable in corona.

Other possible ceramic materials which may be used to coat the inner conductive electrode include alumina, zirconia, boron nitride, beryllium oxide and silicon nitride.

The thickness of the dielectric coating 13 in FIG. 2 used in the corona discharge member of the present invention is such that substantially no conduction current or d.c. charging current is permitted therethrough. Typically, the thickness is such that the combined wire and the dielectric thickness falls in the range from 7 mils (0.178 mm) to about 30 mils (0.762 mm) with typical dielectric thickness of about 2 mils (0.0508 mm) to about 10 mils (0.254 mm). Glasses with dielectric breakdown strengths above 5 KV/mm. have been found by experiment to perform satisfactorily as the dielectric coating material.

The inner conductive electrode, shown as numeral 12 in FIG. 2, may be made of any conventional conductive filament materials. Exemplary of conductive filament materials are stainless steel, gold, aluminum, copper, tungsten, platinum, molybdenum tungsten/molybdenum alloy and the like. The conductive filament material preferably has a tensile strength in excess of about 50,000 p.s.i. (3,500 kg/cm$^2$) and more preferably a tensile strength in excess of about 90,000 p.s.i. (6,300 kg/cm$^2$). Generally, conductive filament materials may have a tensile strength from about 50,000 p.s.i. (3,500 kg/cm$^2$) to about 280,000 p.s.i. (19,600 kg/cm$^2$). The diameter of the inner conductive electrode, normally a wire of any of the conventional conductive filament materials, is not critical and may vary typically between about 0.5 mil (0.012 mm) to about 15 mils (0.38 mm) and preferably is about 3 mils (0.076 mm) to about 6 mils (0.15 mm). Preferred inner conductive electrodes are made from tungsten wire or molybdenum wire.

The corona discharge member 11 (FIG. 2) of the present invention may be supported in conventional fashion at the ends thereof by insulating end blocks (not shown) mounted within the ends of a shield structure (not shown). When mounted in such a fashion, the corona discharge member is generally placed under a small amount of tension in order to prevent the corona discharge member from drooping or sagging during the generation of the corona. Such a mounting means is described in U.S. Pat. No. 4,086,650. When the corona discharge member of the present invention is under sufficient tension to maintain the normally flexible corona discharge member at a fixed position between the support members, the outer dielectric coating must remain under compression. Thus, even when the corona discharge member of the present invention is mounted or supported in insulating end blocks and under tension from said mounting means, the outer dielectric coating must remain under compression, preferably, a compression of about 500 to about 20,000 p.s.i. (35–1,400 kg/cm$^2$) and more preferably from about 8,000 to about 12,000 p.s.i. (560–840 kg/cm$^2$).

The dielectric material may be applied to the conductive electrode in any manner which will place the dielectric coating under compression when the corona discharge member is in a relaxed state or mounted within support members. The method of applying the dielectric coating to the inner conductive electrode so that the resulting corona discharge member comprises an inner conductive electrode and an outer dielectric coating, the outer dielectric coating being under compression, depends upon the dielectric coating material being applied to the inner conductive electrode. The properties and characteristics of the dielectric material dictate the method utilized in applying the dielectric coating. The dielectric material may be applied to the inner conductive electrode in a molten mass and later solidified; it may be applied to the inner conductive electrode by sputtering the dielectric material thereon; it may be applied to the inner conductive electrode by electrodeposition; it may be applied by vapor deposition; it may be applied by surface crystallization or it may be applied by any of other suitable means, including lamination techniques.

The inner conductive electrode may be a single filament or a multiple filament structure and it may comprise any one of a combination of various filament materials described above. The dielectric material may be a pure material or it may be a mixture of materials, for example, as described above. One or more coatings of the dielectric material may be applied to one or more inner conductive electrode filaments.

One of the methods of preparing the improved corona discharge member of the present invention so that the corona discharge member has an inner conductive electrode and an outer dielectric coating wherein the outer dielectric coating is under compression, comprises applying stress or tension to the inner conductive electrode; coating the inner conductive electrode with a dielectric coating capable of being compressed; wetting the surface of the inner conductive electrode with the dielectric material; and after a sufficient bond has been formed at the interface of the dielectric coating material and the inner conductive electrode, releasing the stress on the inner conductive electrode, whereby the inner conductive electrode contracts causing a compression of the outer dielectric material. In this manner, the removal of the tension or stress from the inner conductive electrode transfers the stress load to the glass, and, when there is a good interfacial bond between the inner conductive electrode and the dielectric material, the dielectric material is forced into compression. The stress may be applied to the inner conductive electrode by mounting the inner conductive electrode between two support members and applying the desired stress thereto. For example, it is preferred that the stress applied thereto be sufficient to cause a resultant compression in the dielectric material deposited thereon of greater than 6,000 p.s.i. (420 kg/cm$^2$). Generally, the stress applied to the inner conductive electrode may be between about 50 grams and 1,000 grams and more preferably between about 150 grams and about 500 grams. The only upper limit of stress which may be applied to the inner conductive electrode during the method of preparing the corona discharge member, is the breaking point of the inner conductive member, for example the tungsten wire or the molybdenum wire. Thus, in one preferred embodiment, the stress applied to the inner conductive electrode is between about 50 grams up to within about 0.5 grams of the breaking point of the inner conductive electrode.

When the stress or tension is properly applied to the inner conductive electrode, the inner conductive electrode may be coated with at least one coating or application of the dielectric material capable of being compressed. When the dielectric material is a glass material, a ceramic material, a glass/ceramic material, and the like, the dielectric material is preferably applied to the inner conductive electrode in a molten state. Depending upon the dielectric material, when the dielectric material is of a crystalline nature and capable of forming crystals on the material of the inner conductive electrode, the dielectric material may be deposited upon the inner conductive electrode by growth of crystals upon the inner conductive electrode while the electrode is under stress or tension. Alternatively, when the material is the type which is capable of being deposited electrolytically, or by vapor deposition, the dielectric material may be deposited electrolytically or by vaporization while the inner conductive electrode is under tension. In certain of these cases, it may be necessary to maintain a heated atmosphere about the inner conductive electrode in the area of the deposition of the dielectric material. The heat may be maintained by heating the atmosphere surrounding the inner conductive electrode or by heating the inner conductive electrode element as by applying a current thereto or both.

When the dielectric material is applied to the inner conductive electrode in a molten state or in the presence of heat, the dielectric material is cooled after it has been deposited upon and has wet the surface of the inner conductive electrode. Cooling may be accomplished by passing a stream of air or any other gas over the coated inner conductive electrode, or it may be cooled by standing in air, vacuum or any inert gas. After sufficient cooling has taken place, for example, after the coated inner conductive electrode has been cooled to, for example, room temperature, or any temperature wherein the dielectric material has become solid, has wet the surface of the inner conductive electrode and has formed a bond at the surface of the inner conductive electrode and the dielectric material, the stress or tension on the inner conductive electrode may be released. In this particular instance, the stress is released merely by adjusting the tension of the mounting blocks or supports holding the inner conductive electrode. When the stress or tension on the inner conductive electrode is released, the inner conductive electrode material contracts causing a compression of the outer dielectric coating.

In an alternative embodiment, the process may embrace applying stress to the inner conductive electrode; coating the inner conductive electrode with the dielectric coating capable of being compressed; heating the inner conductive electrode and the dielectric coating material deposited thereon until the dielectric coating wets the surface of the inner conductive electrode; cooling the dielectric material after it has wet the surface of the inner conductive electrode; and releasing the stress on the inner conductive electrode. Alternatively, heat may be applied to the inner conductive electrode and/or to the atmosphere surrounding the inner conductive electrode both during and after the deposition of the dielectric material upon the inner conductive electrode.

When the dielectric material is one which is applied to the inner conductive electrode in a molten or softened state, the dielectric material is preferably applied between the softening point and the working point. These terms are defined and described at pages 582–583 of *Encyclopedia of Chemical Technology,* Kirk-Othmer, Volume 10, 1964. A preferred viscosity for the application of the molten dielectric material is $10^{6+1}$ poise. For example, when the dielectric material is 1720 glass, the dielectric may be applied to the inner conductive electrode at a temperature of between about 700° C. and 1200° C. or more preferably at a temperature of between about 975° C. and about 1,050° C. The viscosity of the 1720 glass when it is applied to the inner conductive electrode is preferably between about $10^4$ and $10^7$ poise. Preferred temperatures and viscosities of other dielectric materials can be determined by one skilled in the art, and with the teachings of the present invention, one skilled in the art can determine optimum conditions and parameters for applying the dielectric material to the inner conductive electrode so that the dielectric material of the improved corona discharge member is in a state of compression.

When the dielectric material is one which is applied to the inner conductive electrode in a molten state, the dielectric material must be heated at a temperature sufficient to induce a molten state therein, and when the material is 1720 glass, the temperature is preferably about 700° C. to about 1,200° C. and more preferably from about 975° C. to about 1,050° C.

In accordance with the present invention, the dielectric material capable of being compressed upon the inner conductive electrode is deposited upon the inner conductive electrode and adheres to the inner conductive electrode. Accordingly, in a broad aspect of the present invention, the improved corona discharge member is made by applying tension to the inner conductive electrode; depositing a dielectric material capable of being compressed upon the inner conductive electrode; adhering the dielectric material to the inner conductive electrode at the interface of the inner conductive electrode and the dielectric material; and releasing the tension on the inner conductive electrode thereby causing compression of the dielectric material. As used herein, adhering is defined as any type of bonding of the dielectric material to the inner conductive electrode. Thus, by adhering the dielectric material to the inner conductive electrode is meant the formation of an interfacial bond between the dielectric material and the inner conductive electrode. Exemplary of ahdering the dielectric material to the inner condutive electrode is the depositing of molten glass upon the inner conductive electrode (wire) so that the molten glass wets the wire, and cooling the molten glass so that the glass becomes bonded to the wire. Thus, the wire is placed under tension before coating and extends following Hooke's law. The glass, in a molten state, flows around the wire, wets it, and cools in a stress-free state upon the wire while the wire is under tension. The load (tension) upon the wire is removed from the wire, and the wire attempts to contract reversably from its Hookian state of extension. The glass, being bonded to the wire, is forced by the contraction of the wire into a state of compression. The composite of the glass and wire is then in a metastable equilibrium, and the wire is not quite relaxed to its original state in extension and the glass in compression. For 1720 glass and tungsten wire, well-bonded interfaces have been observed when the glass is heated between 984° C. and 1,006° C.

Because of the interfacial bond or adherence between the dielectric material and the inner conductive electrode, the stress or tension on the inner conductive electrode remains greater than the tension on the dielectric material. In the foregoing example and in most of the corona discharge members of the present invention when the inner conductive electrode is placed under tension, coated with the dielectric material which becomes bonded to the inner conductive electrode following which the tension is released upon the inner conductive electrode, the compression in the dielectric material is in the direction of the longitudinal axis of the inner conductive electrode.

Figure 1:
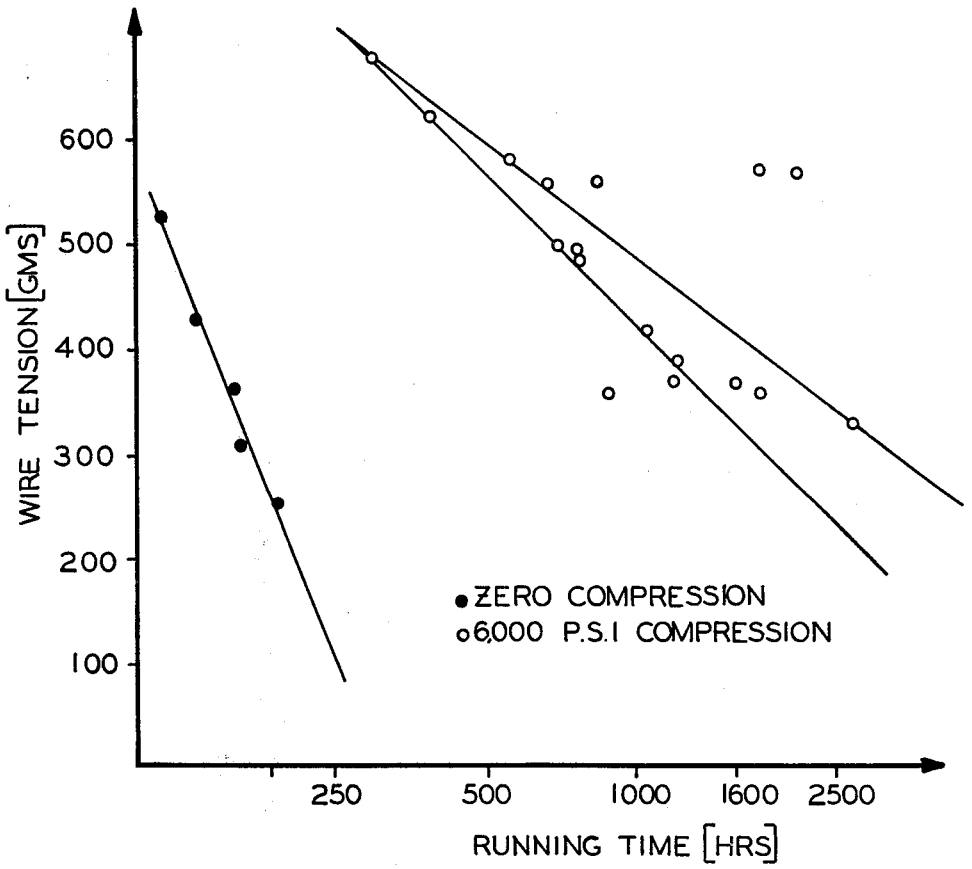
FIG. 1 is a graph showing running time versus wire tension of a conductive electrode having an outer dielectric coating under low compression and a conductive electrode having an outer dielectric coating under high compression.

The following examples further define, describe and compare exemplary corona discharge members of the type having an inner conductive electrode and an outer dielectric coating, the outer dielectric coating being under compression. Comparisons are made with corona discharge members having an inner conductive electrode and an outer dielectric coating wherein the outer dielectric coating is under little or no compression. The examples are included merely to aid in the understanding of the invention, and variations may be made by one skilled in the art without departing from the spirit and scope of this invention. The corona discharge member of the present invention was used in a corona device similar to the device described in U.S. Pat. No. 4,086,650. The corona discharge member of the present invention may be substituted for the corona discharge member designated by numeral 11 in FIG. 1 of U.S. Pat. No. 4,086,650. The corona device of the present invention may be used to deposit a specific net charge on an imaging surface.

EXAMPLE I

A corona discharge member was prepared by coating a 0.076 mm. tungsten wire with 0.076 mm. of a glass designated by the glass code 1720 (see page 542 of *Encyclopedia of Chemical Technology,* Kirk-Othmer, Volume 10, 1964) having a composition of 62% silicon dioxide, 17% aluminum oxide, 5% boron oxide, 1% sodium oxide, 7% magnesium oxide and 8% calcium oxide. The dielectric material coated upon the surface of the tungsten wire had a compression of 6,000 pounds/square inch (p.s.i.). This was determined by the polarimeter measurements discussed above. The corona discharge member having a tungsten filament coated with glass under compression at about 6,000 p.s.i. was placed in a device similar to that of FIG. 1 of U.S. Pat. No. 4,086,650, and the running time in hours was determined at various wire tensions. By wire tension is meant the number of grams of tension that the corona discharge member is subjected to when it is placed in insulating end blocks mounted within the ends of the corotron shield. An a.c. voltage source was connected between a conductive substrate held at a reference potential (machine ground) and the corona wire. The data from this test was collected and plotted in FIG. 1 where running time in hours is shown as the abscissa and wire tension in grams is shown as the ordinate. By examining the graph of FIG. 1 of the drawings, the improved life of the corona discharge member having a glass coating under 6,000 p.s.i. compression was observed.

EXAMPLE II

A corona discharge member similar to the prior art type of corona discharge member having a 0.076 mm. tungsten wire coated with 0.076 mm. of number 1720 glass but having no compression when measured upon a polarimeter in accordance with the compression test set forth above, was placed in the same device described in Example I above and the running time in hours was determined at various wire tensions. The observed readings were placed upon the graph of FIG. 1 and the running time of the corona discharge member of the present invention having a glass coating under compression can be easily compared with the corona discharge member of the prior art wherein the glass coating has little or no compression. The substantial improvement in running time of the corona discharge member of the present invention having an inner conductive tungsten filament and an outer dielectric coating of glass, the outer dielectric coating of glass being under compression, is substantially improved over the running time of the prior art corona discharge member.

EXAMPLE III

A series of corona discharge members were prepared in accordance with Example I above. The tungsten wire was placed under a specified load (in grams) in support members and molten 1720 code number glass was coated upon tungsten wire. After the molten glass was applied to the tungsten wire, the molten glass was cooled and the tension upon the tungsten wire was released. The residual stresses in the wire were measured by means of a polarimeter as described above. Various temperatures at which the molten glass was applied to the tungsten wire, were used to prepare the corona discharge members designated as 9/3 wires (a 3 mil core with a 3 mil coating thereon). The residual stresses versus the load and temperature are shown in the Table below. The residual stresses are recorded in p.s.i. The load is recorded in grams. The temperature is recorded in °C.

The breaking performance of the corona discharge members described above was also determined. The breaking performance is also recorded in the Table below, and those samples wherein the glass dielectric showed at least one break are designated by underlining in the Table. Breaking performance was determined by placing the corona discharge member in an Instron testing device and determining the number of pounds applied to the corona discharge member when breakage occurs. In the Table, the pounds have been converted to grams and are shown as grams therein.

TABLE

RESIDUAL STRESS AND BREAKING PERFORMANCE

| Residual Stress In Samples Prepared At Various Temps. | | | | |
|---|---|---|---|---|
| Load (g) | 984° C. | 994° C. | 1001° C. | 1011° C. |
| 25 | 3400 p.s.i. | 2200 p.s.i. | 2300 p.s.i. | 100 p.s.i. |
| 50 | 4700 p.s.i. | 4100 p.s.i. | 2600 p.s.i. | 600 p.s.i. |
| 100 | 5500 p.s.i. | 4300 p.s.i. | 2700 p.s.i. | 1100 p.s.i. |
| 200 | 5600 p.s.i. | 4400 p.s.i. | 2700 p.s.i. | 1100 p.s.i. |
| Breaking Performance In Grams (Instron Tester) Of Sample Prepared At Above Temperatures | | | | |
| Load (g) | | | | |
| 25 | 2588 g. | 3405 g. | 3042 g. | 3269 g. |
| 50 | 3360 g. | 3314 g. | 2951 g. | 3405 g. |
| 100 | 3360 g. | 3360 g. | 3269 g. | 2815 g. |
| 200 | 3405 g. | 3314 g. | 3360 g. | 3360 g. |

Corona discharge members were prepared in accordance with the above method except the glass was deposited upon molybdenum wire. Similar results were obtained with molybdenum wire coated with the glass dielectric as reported above.

From the foregoing Table, it can be seen that increasing the load (tension) upon the wire, and decreasing the temperature at which the molten glass is applied to the wire, generally increases the residual stress in the corona discharge member, the glass coated wire, prepared thereby. The decreased residual stress at high temperatures may result from the contribution of the glass drawdown process to the wire retardation.

EXAMPLE IV

A 0.076 mm. tungsten wire was placed between two support members, and a load of 200 grams was applied to the tungsten wire. Molten code 1720 glass at 984° C. was placed upon the wire and the glass flowed around the wire and wet the surface of the tungsten wire. The glass was cooled slowly to room temperature and the load upon the tungsten wire was released. The glass was bonded to the wire, and by means of polarimeter (as discussed above), the compression of the glass upon the wire was measured. The polarimeter showed a compression of about 5600 p.s.i. for the glass material.

EXAMPLE V

A corona discharge member was prepared in accordance with Example IV except molten code 3320 glass was applied to a molybdenum wire. The code 3320 glass comprises by weight, 76% silicon dioxide, 3% aluminum oxide, 14% boron oxide, 4% sodium oxide, 2% potassium oxide and 1% uranium oxide. The compression of the glass was measured by means of a polarimeter and similar compression results were obtained.

EXAMPLE VI

A coating of silicon nitride is deposited by chemical vapor deposition onto the surface of a 0.076 mm. diameter tungsten wire under a tension of 200 grams. The coated wire is heated at 995° for ½ hour and then cooled to room temperature. The tension upon the tungsten wire is released when the coated wire reaches room temperature. The thickness of the coating is approximately 0.076 mm. The silicon nitride coated wire having silicon nitride under compression is then assembled in the corona discharge device described in Example I above to perform as a charging member.

EXAMPLE VII

A coating of silica ($SiO_2$) is vapor deposited over a copper wire as in Example VI and heated in a similar manner. Upon cooling, the tension is released from the copper wire and the corona discharge member having a dielectric coating of silica under compression is tested in a corona charging unit similar to the one described above in Example I.

In accordance with the present invention, there has been described a corona discharge member having an increased useful charging life. A process has been described for coating an inner conductive electrode with an outer dielectric material in such a manner that the corona discharge member formed thereby has a substantially improved fatigue life. The corona discharge members of the present invention have increased static and dynamic lives.

While the invention has been described with respect to preferred embodiments, it will be apparent that certain modifications and changes can be made without departing from the spirit and scope of the invention and therefore, it is intended that the foregoing disclosure be limited only by the claims appended hereto.

What is claimed is:

1. An improved corona discharge member of the type having an inner conductive electrode and an outer dielectric coating made by the process comprising applying tension to the inner conductive electrode; depositing a dielectric material adhering the dielectric material to the inner conductive electrode at the interface of the inner conductive electrode and the dielectric material; and releasing the tension on the inner conductive electrode thereby causing compression of the dielectric material.

2. An improved corona discharge member of the type having an inner conductive electrode and an outer dielectric coating made by the process comprising applying stress to the inner conductive electrode; coating the inner conductive electrode with a dielectric coating capable of being compressed, said dielectric being in a molten state; cooling the dielectric after it has wet the surface of the inner conductive electrode; and releasing the stress on the inner conductive electrode, whereby the inner conductive electrode contracts causing a compression of the outer dielectric coating.

3. The improved corona discharge member of claim 2 wherein the dielectric coating is compressed glass.

4. The improved corona discharge member of claim 2 wherein the dielectric coating is compressed ceramic.

5. The improved corona discharge member of claim 2 wherein the inner conductive electrode to which stress is applied, is tungsten.

6. The improved corona discharge member of claim 2 wherein the inner conductive electrode to which stress is applied, is molybdenum.

7. The improved corona discharge member of claim 2 wherein the stress is applied to the inner conductive electrode is between about 50 grams and 1,000 grams.

8. The improved corona discharge member of claim 2 wherein the stress applied to the inner conductive electrode is between about 150 grams and about 500 grams.

9. The improved corona discharge device of claim 2 wherein the dielectric is applied to the inner conductive electrode at a temperature of between 700° C. and 1,200° C.

10. The improved corona discharge device of claim 2 wherein the dielectric is applied to the inner conductive electrode at a temperature of between 975° C. and 1,050° C.

11. The improved corona discharge device of claim 2 wherein the dielectric is applied to the inner conductive electrode at a viscosity of between about $10^4$ and $10^7$ poise.

12. The improved corona discharge device of claim 2 wherein the compression of the outer dielectric coating after the stress on the inner conductive electrode is released, is about 500 p.s.i. (35 kg/cm$^2$) to about 20,000 p.s.i. (1,400 kg/cm$^2$).

13. The improved corona discharge device of claim 2 wherein the compression of the outer dielectric coating after the stress on the inner conductive electrode is released, is about 8,000 p.s.i. (560 kg/cm$^2$) to about 12,000 p.s.i. (840 kg/cm$^2$).

14. A method of making a coated corona discharge member of the type having an inner conductive electrode and an outer dielectric coating comprising:

(a) applying stress to the inner conductive electrode;

(b) coating the inner conductive electrode with a dielectric coating capable of being compressed, the dielectric being in a molten state;

(c) cooling the dielectric after it has wet the surface of the inner conductive electrode to a temperature at which the dielectric becomes securely bonded to the inner conductive electrode; and (d) releasing the stress on the inner conductive electrode whereby the inner conductive electrode contracts causing a compression of the outer dielectric coating while the outer dielectric coating remains bonded to the inner conductive electrode.

15. The method of claim 14 wherein the inner conductive electrode is coated with about 0.045 mm. to about 0.254 mm. of the dielectric.

16. The method of claim 14 wherein the dielectric coating is compressed glass.

17. The method of claim 14 wherein the dielectric coating is compressed ceramic.

18. The method of claim 14 wherein the inner conductive electrode to which stress is applied, is tungsten wire.

19. The method of claim 14 wherein the inner conductive electrode is applied, is molybdenum wire.

20. The method of claim 14 wherein the stress applied to the inner conductive electrode prior to and during the coating thereof is about 15 grams up to within about 0.5 gram of the breaking point of the inner conductive electrode.

21. The method of claim 14 wherein the stress applied to the inner conductive electrode prior to and during the coating thereof is about 50 grams to about 500 grams.

22. The method of claim 14 wherein the dielectric is heated at a temperature sufficient to induce a molten state therein.

23. The method of claim 14 wherein the dielectric is heated at a temperature of about 700° C. to about 1,200° C. to induce the molten state.

24. The method of claim 14 wherein the dielectric is heated at a temperature of about 975° C. to about 1,050° C.

25. The method of claim 15 wherein the dielectric is coated upon the inner conductive electrode at a viscosity of between about $10^4$ to about $10^7$ poise.

* * * * *